US005901903A

United States Patent [19]

Sanders et al.

[11] Patent Number: 5,901,903

[45] Date of Patent: May 11, 1999

[54] CERTIFIED MAIL ENVELOPE

[75] Inventors: Raymond W. Sanders; Joseph R. Ferrarelli; Thomas C. Sanders, all of Cincinnati, Ohio

[73] Assignee: Ferrarelli, Inc., Cincinnati, Ohio

[21] Appl. No.: 08/912,414

[22] Filed: Aug. 18, 1997

[51] Int. Cl.[6] ..... B65D 27/06

[52] U.S. Cl. ..... 229/69; 229/71; 229/92.8; 229/300

[58] Field of Search ..... 229/300, 92.8, 229/69, 71

[56] References Cited

U.S. PATENT DOCUMENTS

| | | | |
|---|---|---|---|
| 1,568,880 | 1/1926 | Conklin | 229/300 X |
| 2,153,504 | 4/1939 | Didier | 229/92.8 X |
| 3,580,488 | 5/1971 | Komen | 229/69 |
| 4,055,294 | 10/1977 | Traise | 229/69 |
| 4,429,827 | 2/1984 | Murray . | |
| 4,726,804 | 2/1988 | Stitcher | 229/69 X |
| 4,892,246 | 1/1990 | Norman | 229/92.8 |
| 5,183,203 | 2/1993 | Sanders . | |
| 5,476,420 | 12/1995 | Manning | 229/69 X |
| 5,626,286 | 5/1997 | Petkovsek | 229/300 |
| 5,752,647 | 5/1998 | Schubert et al. | 229/300 X |

*Primary Examiner*—Jes F. Pascua
*Attorney, Agent, or Firm*—Frost & Jacobs LLP

[57] ABSTRACT

Envelopes for certified mail each comprising a panel and a flap constituting an integral, one-piece assembly of thin card stock with a fold line between the panel and the flap. When the panel of the panel and flap assembly comprises the rear panel of an envelope a removable return receipt card is formed therein by lines of perforations and is preprinted on both sides. A Certified Mail endorsement and a return receipt request are preprinted on the flap. A paper front panel is adhered to the inside surface of the rear panel. When the panel of the panel and flap assembly comprises the front panel of an envelope a removable return receipt card is formed in the flap by lines of perforations and is preprinted on both sides. A Certified Mail endorsement and return receipt request are preprinted on the front panel. A paper rear panel is adhered to the inside surface of the front panel. In both embodiments, the envelopes may be assembled individually or in the form of a continuous strip thereof. A strip of envelopes may be provided with removable pin-feed strips.

59 Claims, 7 Drawing Sheets

CERTIFIED MAIL ENVELOPE

TECHNICAL FIELD

The invention relates to an envelope for mailing documents by Certified Mail, and more particularly to such an envelope assembly wherein the envelope rear panel and flap constitute an integral, one-piece member of thin card stock, with a paper, windowed front panel affixed to the rear panel. The certified mail endorsement and the return receipt request are printed on the envelope flap, and the return receipt constitutes an integral, one-piece part of the envelope rear panel and is removable therefrom along lines of perforations. In another embodiment, the front panel and the flap can constitute an integral, one-piece member of thin card stock with a paper rear panel affixed to the front panel, the return receipt constituting an integral, one-piece removable part of the flap.

BACKGROUND ART

The mailing of a document or the like by Certified Mail, including the manual filling out of the requisite postal service forms is time-consuming. The preparation of Certified Mail becomes particularly labor-intensive when large quantities of such mail are generated.

As a consequence, prior art workers have devised various types of document mailers and systems for Certified Mail. This is exemplified, for example, by U.S. Pat. No. 4,429,827. Generally, the prior art mailers and systems are characterized by complexity of construction and use.

Prior art workers have also devised various types of envelopes for Certified Mail, severable from a continuous strip of such envelopes. In the most common practice, the return receipt form is removably affixed to the face of the envelope adjacent to one end thereof, or constitutes a separate portion extending from one end of the envelope with a line of perforations along which it may be severed from the adjacent end of the envelope. Many of this these last mentioned prior art mailers are of such nature that the contents of the envelope must be located within the envelope at the time of envelope assembly. In other words, these envelopes are not intended to have a document placed in them after the envelope has been assembled and, therefore, they do not constitute multi-purpose envelopes. Envelopes of this general type are usually too wide for use with most conventional computer printers and optical bar code scanners.

U.S. Pat. No. 5,183,203 teaches an envelope assembly which overcomes most of the above-indicated problems. The envelope assembly is so dimensioned as to be capable of being fed through a computer printer and an optical scanner. It is also capable of receiving and enclosing an 8 and ½ inch wide document.

U.S. Pat. No. 5,183,203 teaches the making of the envelope assembly in the form of a continuous strip of such assemblies provided in roll form or zig-zag fold form for feeding through a computer printer. The envelope assemblies may be provided with detachable, perforated pin feed edge portions for the drive of certain types of computer printers. For other types of printers, such as laser printers, the envelopes may be detached from the strip and individually fed therethrough without the requirement of pin feed edge strips. Each envelope assembly of the strip thereof comprises a front panel and flap member separated by a fold line. Each front panel and flap member is joined to the next front panel and flap member at a line of perforations so that it may ultimately be torn from the continuous strip. A discrete second ply, constituting a rear panel of the envelope assembly, is glued to the front panel in such a way as to form an opening extending along the fold line of the flap. A return receipt card is removably affixed to the outside surface of each envelope assembly flap. A Certified Mail endorsement is preprinted on each front panel centrally thereof and adjacent the fold line between the front panel and the flap. A return receipt request is preprinted on each front panel adjacent and beneath its Certified Mail endorsement.

The present invention constitutes an improvement upon the envelope assemblies of U.S. Pat. No. 5,183,203. The present invention is based upon the discovery that an even simpler Certified Mail envelope, easier to make and use, can be provided. In a first embodiment, the rear panel and flap of the envelope constitute a one-piece integral structure and are made of thin card stock. The return receipt card constitutes an integral, one-piece part of the envelope rear panel and is removable therefrom along lines of perforations. The envelope is provided with a front panel having a window therein. The flap folds over the upper part of the front panel and is provided with the Certified Mail endorsement and the return receipt request. In a second embodiment the front panel and flap of the envelope constitute a one-piece integral structure made of card stock. The return receipt card constitutes an integral, one-piece part of the flap and is removable therefrom along lines of perforations. The envelope is provided with a rear panel and the flap folds over the upper part of the rear panel.

DISCLOSURE OF THE INVENTION

According to the invention there is provided a simple envelope assembly for Certified Mail. In a first embodiment the envelope assembly comprises a rear panel and a flap. The rear panel and flap constitute an integral, one-piece member with a fold line separating the rear panel and the flap. The rear panel and flap member is made of a thin card stock and has an interior surface and an exterior surface.

A return receipt card is printed both sides in the center of the rear panel with its peripheral edges defined by lines of perforations along which it may be severed from the rear panel. The return receipt card is preprinted with the conventional indicia on both the inside surface and the outside surface of the rear panel.

The envelope also includes a paper front panel adhered to the interior surface of the rear panel along the side and bottom edges thereof. The top edge of the front panel is located near and parallel to the flap fold line, and defines the envelope opening. The front panel may have a window formed therein which generally overlies the return receipt card portion of the rear panel.

The flap when bent along its fold line, overlies the upper portion of the front panel. The interior surface of the flap is provided with an appropriate adhesive by which it may be adhered to the upper portion of the front panel. The exterior surface of the flap is preprinted with the Certified Mail endorsement and the return receipt request. Room is provided in the upper corners of the exterior surface of the flap for a return address and postage or a postage permit.

In a second embodiment of the envelope assembly, a front panel and flap constitute an integral, one-piece member with a fold line separating the front panel and the flap. The front panel and flap member is made of a thin card stock and has both an interior and exterior surface.

The return receipt card is preprinted with conventional indicia on both sides on the flap with at least three of its four peripheral edges defined by lines of perforations along which it may be severed from the flap.

The envelope also includes a paper rear panel adhered to the interior surface of the front panel along the side and bottom edges thereof. The top edge of the rear panel is located near and parallel to the flap fold line, and defines the envelope opening.

When the flap is bent along its fold line, it overlies the upper portion of the rear panel. The interior surface of the flap is provided with an appropriate adhesive by which it may be adhered to the upper portion of the rear panel. The exterior surface of the front panel is preprinted with the Certified Mail endorsement and the return receipt request. Room is provided in the upper corners of the exterior surface of the front panel for a return address and postage or a postage permit.

The envelope assemblies of the present invention may be made individually, or in a continuous strip. In the first embodiment, a plurality of rear panel and flap members may be formed in a continuous strip with a transverse line of perforations between each rear panel and flap member segment of the strip. The perforations about the return receipt card are preformed in the strip and the indicia on each envelope rear panel and flap are preprinted on the strip. To each rear panel of the strip there is adhered a front panel.

In the second embodiment, a plurality of front panel and flap members may be formed in a continuous strip with a transverse line of perforations between each front panel and flap member segment of the strip. The perforations about the return receipt card are preformed in each flap portion of the strip and the indicia on each front panel and flap are preprinted on the strip. To each front panel of the strip there is adhered a rear panel.

In both embodiments, the continuous strip of envelopes may be rolled or zig-zag folded and may be fed through an appropriate printer. When it is intended to be used with a printer of the type having a pin or sprocket feed, the strip of envelopes may be provided with removable, narrow feed strips as is well known in the art. When printers having a friction feed are used, the narrow perforated feed strips may be eliminated. For certain types of laser printers the envelopes may be removed from the strip and fed individually into the laser printer. It is within the scope of the invention to make the envelope assemblies individually.

DETAILED DESCRIPTION OF THE INVENTION

Figure 1:
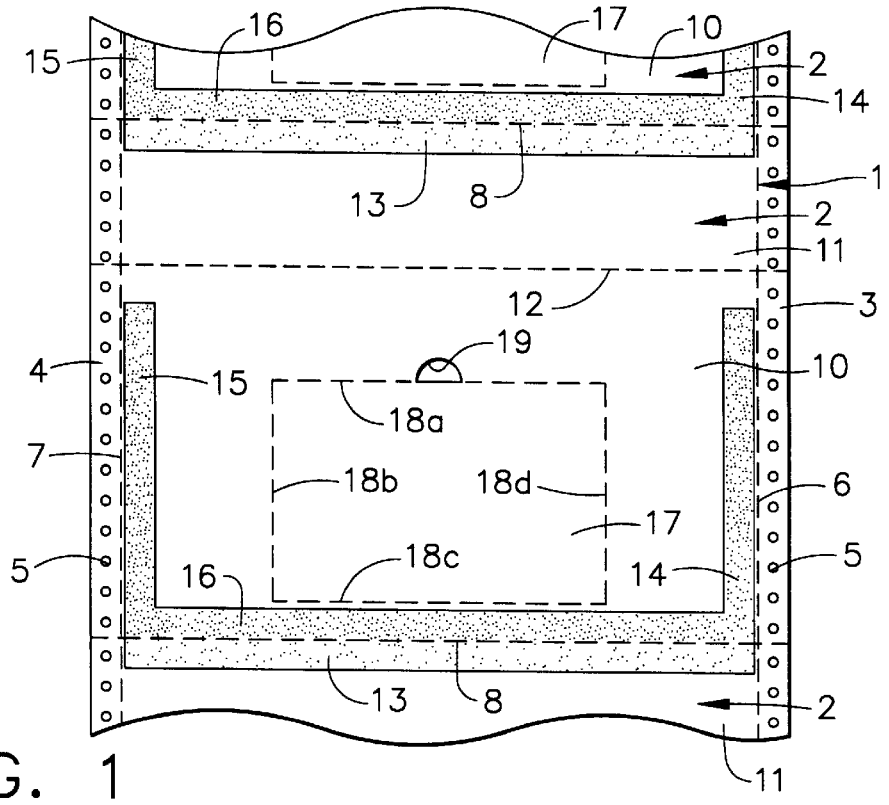
FIG. 1 is a fragmentary elevational view of a continuous strip of rear panel and flap members showing the inside surfaces thereof.

In each of the Figures like parts have been given like index numerals. Referring first to FIG. 1, this Figure illustrates a continuous strip, generally indicated at 1, made up of a plurality of envelope rear panel and flap members or segments, generally indicated at 2. The longitudinal edges of strip 1 are provided with conventional, narrow drive strips 3 and 4, each provided with holes 5 spaced therealong. Strips 3 and 4 enable the advancement of main strip 1 through a conventional printer having a pin feed or sprocket-type advancing mechanism, as is well known in the art. The narrow strips 3 and 4 are severable from the main strip 1 along longitudinal lines of perforations 6 and 7. The drive strips 3 and 4 are optional and it is within the scope of the present invention to eliminate them from main strip 1.

The equal length segments 2 of main strip 1 are separated by transverse lines of perforations, two of which are shown at 8 in FIG. 1. As indicated above, each segment between adjacent lines of perforations 8 constitutes the rear panel and flap member of an envelope assembly of the present invention. The envelope rear panel is indicated at 10 and the envelope flap is indicated at 11. Each rear panel 10 and flap 11 of a segment constitute an integral, one-piece part with a fold line 12 delineating the two.

Flap 11 may be provided on its inner surface with a band of remoistenable glue by which the flap is held in its closed position, as will be apparent hereinafter. The remoistenable glue 13 extends parallel to the upper edge of flap 11, as defined by line of perforations 8. In a similar fashion, the rear panel of the envelope may be provided with bands of glue 14 and 15 along its side edges as defined by the lines of perforations 6 and 7 and along its bottom edge, as defined by the adjacent transverse line of perforations 8. As will be apparent hereinafter, the bands of glue 14 through 16 constitute the means by which the front panel of the envelope, to be described hereinafter, is affixed to the rear panel. It will be noted that the bands of glue 14 and 15 terminate just short of fold line 12.

Each segment 2 of the continuous strip 1 is completed by providing its rear panel portion 10 with a return receipt card 17. The return receipt card is an integral, one-piece part of rear panel 1 and is defined by lines of perforations 18*a*, 18*b*, 18*c* and 18*d*. At the center of the line of perforations 18*a*, there is a semicircular opening 19. The opening 19 is adapted to receive the thumb or finger of the user, enabling him to grasp the return receipt card and tear it out of the rear envelope panel 10 along the lines of perforation 18*a* through 18*d*.

Figure 2:
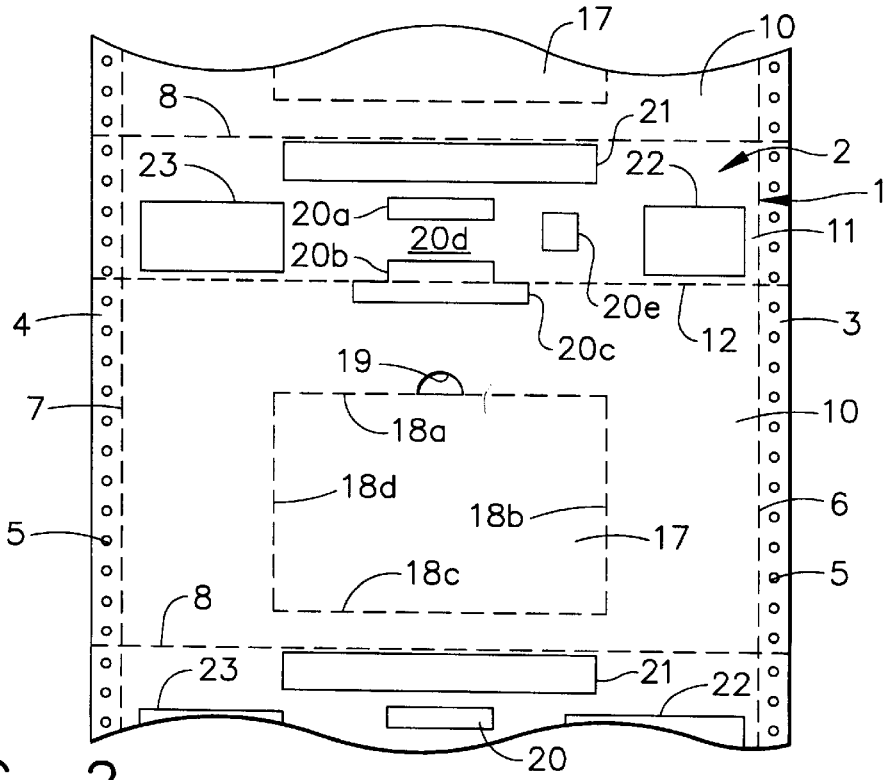
FIG. 2 is a fragmentary elevational view of the continuous strip of rear panel and flap members illustrating the exterior surfaces thereof.

Reference is now made to FIG. 2 which is a fragmentary view of the strip 1 as viewed from its exterior surface. Again, like parts have been given like index numerals. On the exterior side of rear panel 10, the return receipt card 17 may be preprinted with all the necessary indicia to be completed by the addressee in accordance with the instructions of the United States Postal Service.

The envelope assembly of the present invention is primarily intended for use by senders who generate large quantities of Certified Mail. It is for this reason that the return receipt card 17 may be preprinted with the sender's address. For the same reason, the outside surface of each flap 11 may be preprinted with a Certified Mail endorsement shown at 20*a*, 20*b* and 20*c*. The Certified Mail endorsement is preferably centered with respect to transverse fold line 12. The part 20*c* of the endorsement extends onto the rear panel 10.

Below the Certified Mail endorsement the words "RETURN RECEIPT REQUESTED" (not shown) may be printed in the area designated by the imaginary rectangle 21. The flap is also provided with a space, designated by imaginary rectangle 22 for a return address. Finally, the flap is provided with a space, indicated by imaginary rectangle 23, and constituting the area for postage or a postage permit. In instances where the sender generates a sufficient quantity of Certified Mail to justify it, his return address may be preprinted in the imaginary rectangle 22.

Each segment 2 of the continuous strip is made into a complete envelope assembly by a rectangular paper front panel 24. The front panel 24 is provided with a window 25. Each front panel 24 is adhered to its respective rear panel 10 of the continuous strip 1 by means of the glue bands 14, 15 and 16. It would be within the scope of the invention to apply the glue bands 14, 15 and 16 to the inside surface of front panel 24 rather than to the inside surface of rear panel 10, as would be obvious to one skilled in the art. The front panel 24 with its window 25 is clearly shown mounted on the rear panel 10 in FIG. 3. The top edge of front panel 24 is not adhered to rear panel 10 and serves as the opening of the envelope. As indicated above, the sender's return address may be preprinted on the inside surfaces of the return receipt cards 17, before the front panels 24 are applied to the strip 1, when the quantity of Certified Mail generated by the sender warrants such preprinting. When this is not the case, the return address information may be applied to the return receipt cards 17 by printing, by typing or by hand through the windows 25 of the front panels 24 after they are applied to strip 1. When the sender's address is preprinted before application of the front panel, the front panel window may be eliminated if desired.

When additional information is to be applied to the envelopes by typing, printing or the like, the envelopes may remain in strip form with the drive strips 3 and 4 if required. The drive strips 3 and 4 may be removed from strip 1 if not required. If it is known that the drive strips 3 and 4 will not be required, the strip 1 may be made without them.

Figure 4:
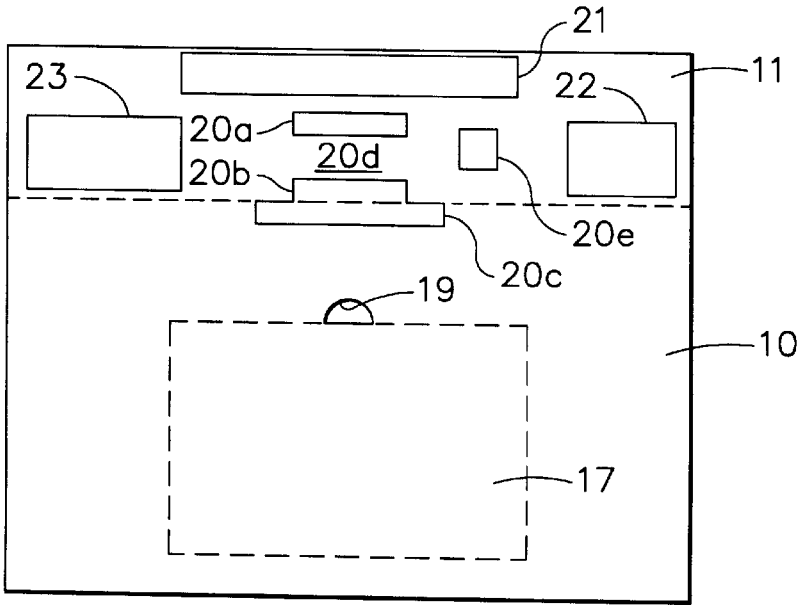
FIG. 4 is a rear elevational view of an envelope of the present invention.
Figure 5:
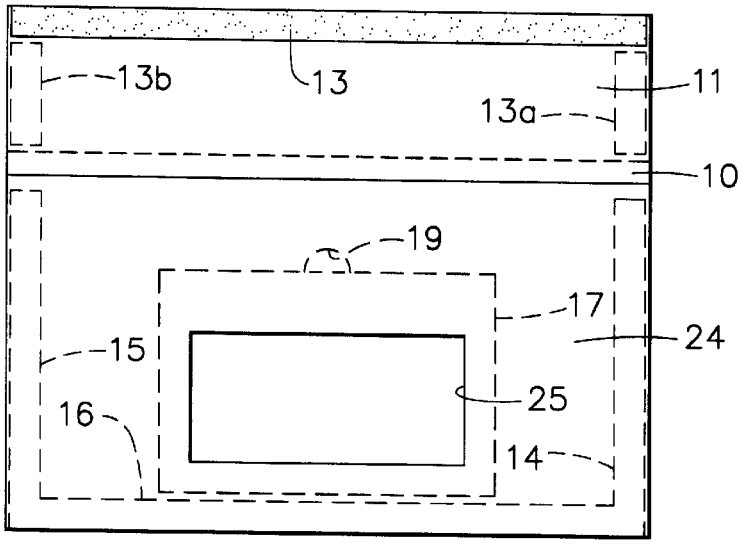
FIG. 5 is a front elevational view of the envelope of FIG. 4.
Figure 6:
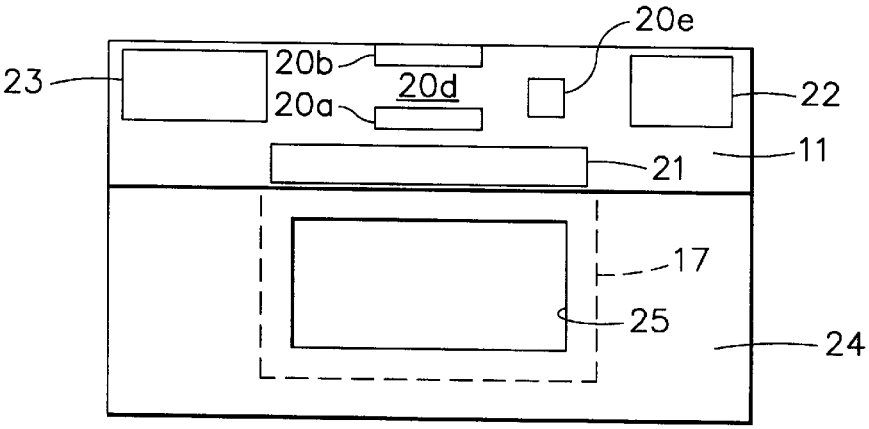
FIG. 6 is a front elevational view of an envelope of the present invention with the flap in closed position.
Figure 7:
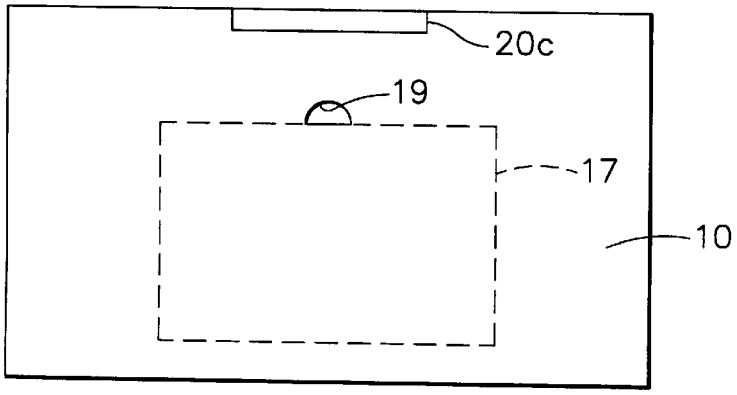
FIG. 7 is a rear elevational view of the envelope of the present invention with the flap in closed position.

FIGS. 4 and 5 are respectively a rear elevational view and a front elevational view of an envelope of the present invention which has been removed from the strip 1. FIGS. 6 and 7 are, respectively, a front elevational view and a rear elevational view of the envelope of FIGS. 4 and 5 with the flap 11 folded and sealed against the front panel 24.

Figure 3:
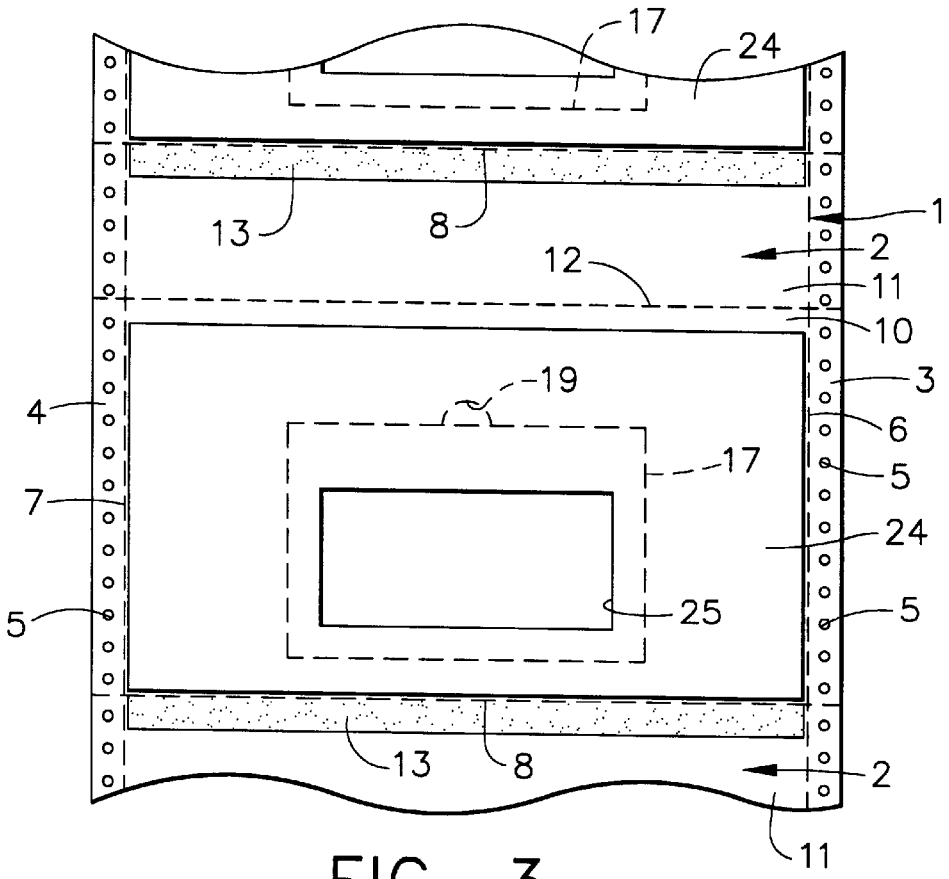
FIG. 3 is a fragmentary elevational view similar to FIG. 1, and illustrating front panels affixed to the strip.

The completed envelope of the present invention is illustrated in FIG. 3 as part of a continuous strip thereof. The completed envelope is shown in individual form in FIGS. 4, 5, 6 and 7. In either case, it is within the scope of the invention to provide the flap 11 with side bands of remoistenable glue, as is indicated in broken lines at 13*a* and 13*b* in FIG. 5.

Figure 8:
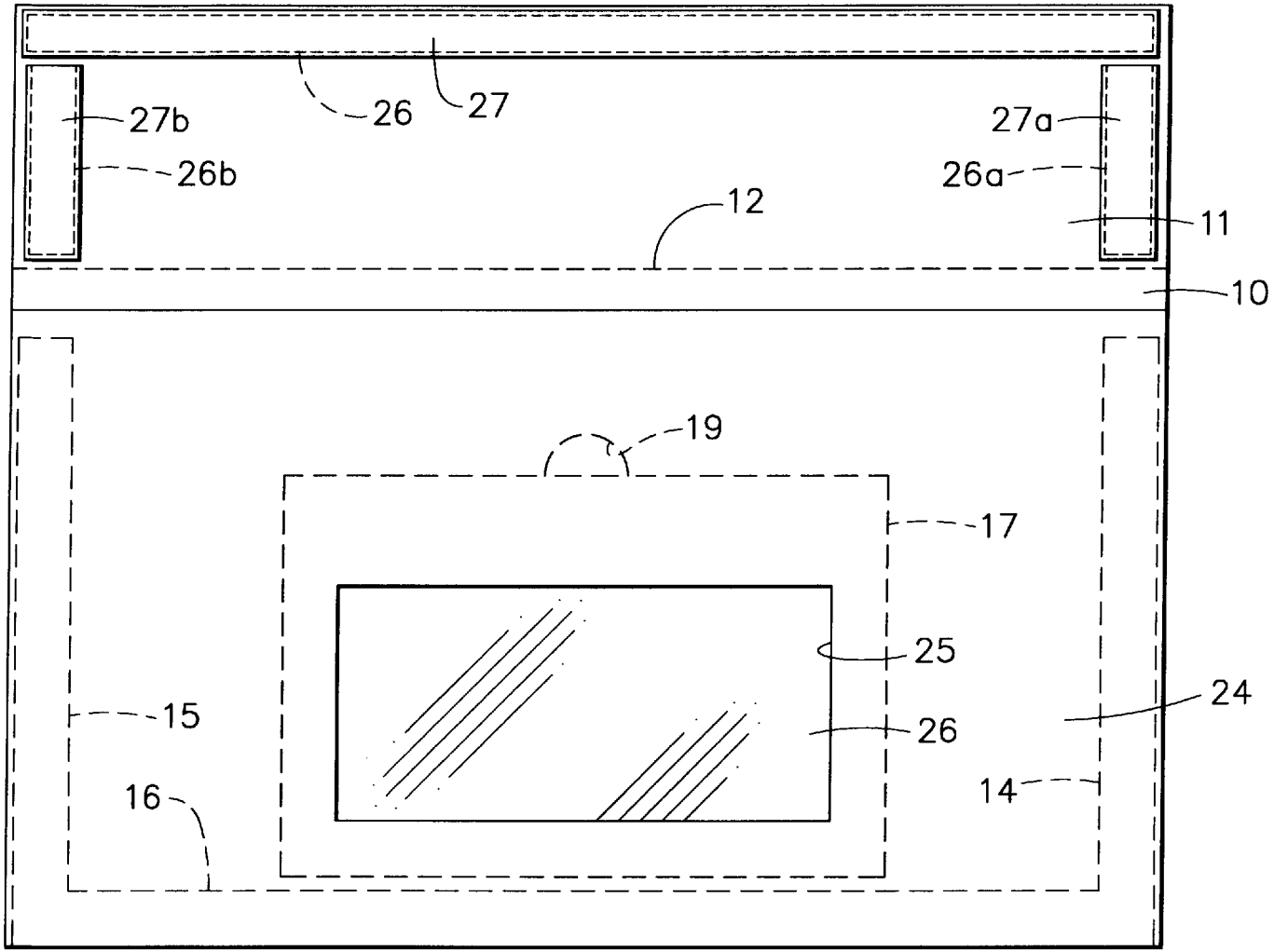
FIGS. 8 and 9 are front elevational views, similar to FIG. 5, and illustrating modified embodiments of the envelope of the present invention.

FIG. 8 is similar to FIG. 5 but illustrates an instance where the flap 11 is provided with a transverse band of pressure sensitive glue 26 and side bands of pressure sensitive glue 26*a* and 26*b*. The transverse band 26 of pressure sensitive glue is provided with a removable release tape 27. Similarly, the side bands 26*a* and 26*b* of pressure sensitive glue are provided with release tapes 27*a* and 27*b*, respectively. It will be understood that the side bands 26*a* and 26*b* of pressure sensitive glue and their respective release tapes 27*a* and 27*b* are optional and can be eliminated, if desired.

Figure 9:
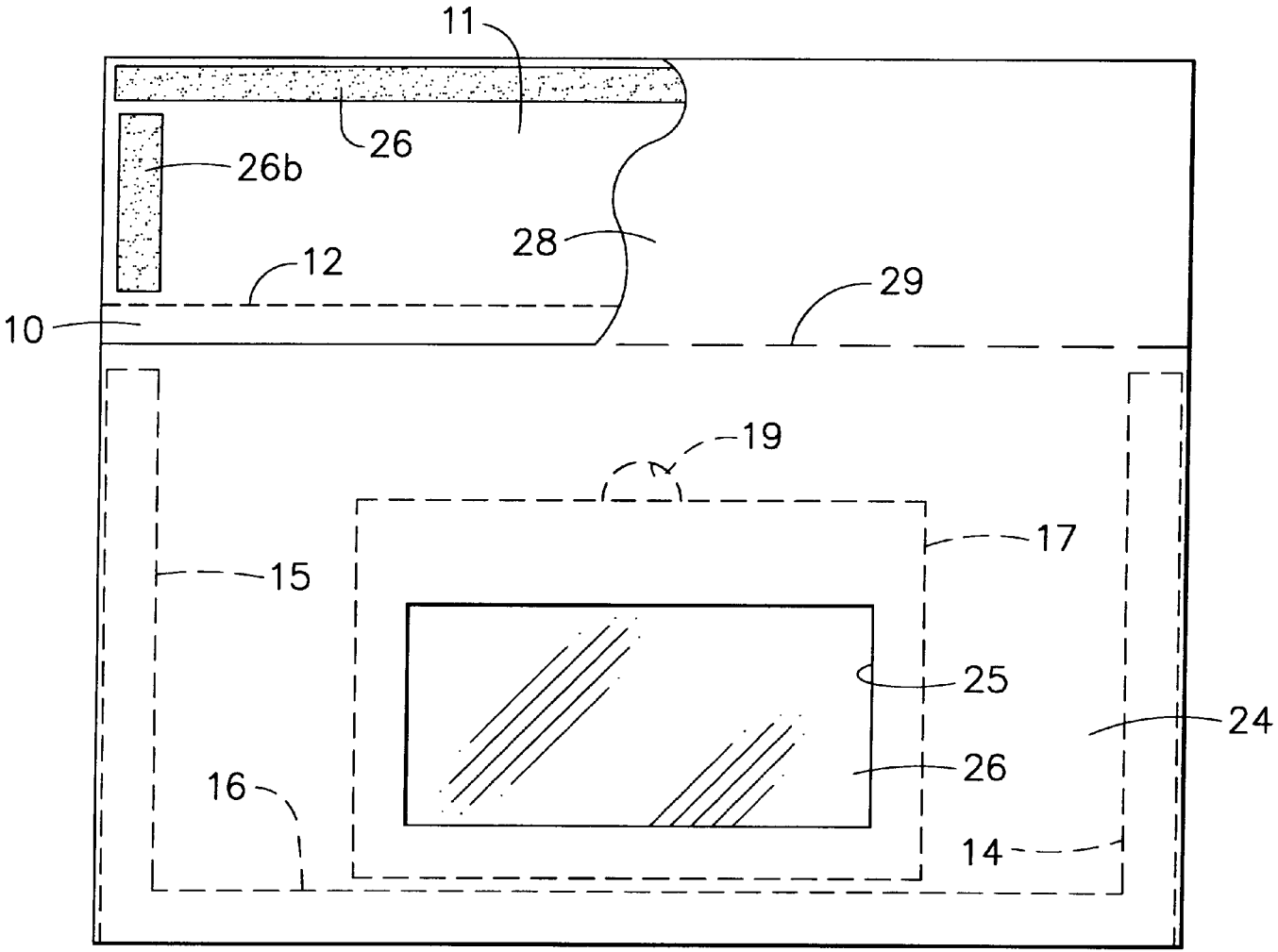

FIG. 9 is similar to FIG. 8. In this instance, however, the front panel 24 is provided with an extended portion 28 sized to overlie and be co-extensive with flap 11. The extended portion 28 of front panel 24 has its inside surface coated with an appropriate release material to cooperate with the pressure sensitive tape on the flap 11. When the envelope is to be used, the extended portion 28 is removed from the flap and from the front panel 24 along the line of perforations 29.

Yet another alternative would be to coat a large portion of the inside surface of flap 11 with a pressure sensitive adhesive, providing the inside surface of the flap with a release overlay like the extended portion 28 of FIG. 8, but not connected to flap 24 and substantially co-extensive with pressure sensitive glue applied to flap 11.

In an instance where the sender uses Certified Mail in such quantities as to justify preprinting the return receipt card with the sender's return address information, the window 25 may be provided with a clear cover adhered to the inside surface of front panel 24. Such a clear cover is shown at 29 in FIGS. 8 and 9. The cover may be made of any appropriate thin, transparent material such as plastic or the like.

In an exemplary embodiment of the envelope assembly of the present invention, the rear panel and integral flap was made of a 100 pound white tag or other paper card stock having a thickness of 0.007 inch. This is true whether made individually, or in the form of the continuous strip 1. The front panel 24 can be made of a 15, 20 or 24 pound bond paper. If a laser printer is used, a 15 or 20 pound bond would be preferred, a 24 pound bond can be used with a matrix printer.

The rear panel and flap had a side-to-side width of 10.5". This does not include the drive strips 3 and 4, each of which were 0.5" in width. The rear panel and flap had a longitudinal dimension from the lower edge of the rear panel to the top edge of the flap of 8.5". The front panel 24, itself, was of the same width as rear panel 10 and had an overall height from its bottom edge to its top edge of 5.5". The glue bands 14, 15 and 16 were of such width that the inside dimensions of each envelope assembly (i.e., the space between the rear panel 10 and the front panel 24) were 10" in width and 5.75" in height. Each closure flap portion was of the same width (10.5") as the rear panel 10 and front panel 24. The height dimension from fold line 12 to the upper edge of flap 11 should not be less than 2.5" or more than 5".

The portion 20*a* of the Certified Mail endorsement was printed in green ink and had a width of 1.75" and a length of ⅜" and contained the word "MAIL" in white letters. The portion 20*b* of the Certified Mail endorsement was printed in the same green ink and was of the same dimensions, containing the word "CERTIFIED" in white letters. Finally, the Certified Mail endorsement portion 20*c*, which is located on the rear panel of the envelope, had a width of 3" and a length of ⅜", and was of the same green color. The space between portions 20*a* and 20*b* of the Certified Mail endorsement is adapted to receive the article number, as is well known in the art. It would be within the scope of the invention to make the space 20*c* a window through which the article number is viewed, the article number being imprinted on the envelope contents. The portions 20*a*, 20*b*, and 20*c* are in compliance with postal regulations.

A small block of taggant ink 20*e* may be located to the right of space 20*d* so that the Certified Mail envelope can be separated as it goes through the postal machinery.

The words "RETURN RECEIPT REQUESTED" are printed in the area designated by imaginary rectangle 21 using ¼" high letters. As indicated above, the return address may be printed in the area of rectangle 23.

The Certified Mail return receipt card 17 was printed both sides with green ink with the appropriate lines and indicia in black on both sides. The exterior surface of the card was preprinted with an "X" to indicate the type of service desired, i.e. "CERTIFIED." As indicated above, the sender's return address may be preprinted on the inside surface of the return receipt card, or printed thereon through the open window of front panel 24.

The envelope assembly of the present invention, having been described in detail, the manner in which it is used can now be set forth.

When the envelopes are made as part of a continuous strip thereof, they are appropriately introduced into the feed mechanism of a computer printer. In instances where the computer printer does not have a sprocket-type feed, as in the case of certain laser printers and the like, the envelope assemblies may be severed individually from the strip and hand-fed into the printer.

The computer will be programmed to enter the addressee's address and the article number on the certified return receipt card 17. The article number will also be entered in the space 20*d* between the portions 20*a* and 20*b* of the Certified Mail endorsement. A bar code may also be imprinted on the front panel 24 below the window 25 and to the right of center. Thereafter, it is only necessary to introduce the desired documents into the envelope assembly between the rear panel 10 and the front panel 24 and to seal the flap 11 in closed position. The documents introduced into the envelope, will bear the addressee's address which will show through window 25. Postage may be added in any conventional manner in the area designated by imaginary rectangle 22.

From the above description it will be apparent that any appropriate document or documents can be inserted in the envelope assembly, rendering the envelope assembly multipurpose, as opposed to those prior art structures wherein the contents of the envelope are inserted during assembly of the envelope. The envelope can easily accommodate a document having a width of up to about 8½". The width of the envelope assembly is such that it can be used with most types of computer printers. No preparation time and no special manipulation is required. The Certified Mail endorsement and the Certified Mail return receipt card are together as part of the same envelope, eliminating any chance of mix-up of the article numbers. The envelope assembly of the present invention does not require the separate step of gluing a return receipt card to a portion of the envelope assembly. The complete envelope assembly is made up of a front panel portion and a rear panel and flap portion so that its structure is very simple and the envelope is very simple to use.

The envelope assembly of the present invention eliminates the manual preparation of a FIRM MAILING BOOK such as the United States Postal Service Form 3877. The computer used in association with the envelope assembly may generate a FIRM MAILING BOOK, PS Form 3877 including the Certified Mail Number, and the name and address of the addressee and the date of mailing. The envelope assembly allows the use of a bar code at the time of printing of the envelope by the computer printer. The envelope is so sized that it will readily go through an optical bar code scanner. The envelope assembly also allows the use of a preselected block of article numbers obtained from the post office. The simplicity of the envelope of the present invention lies primarily in the fact that the rear panel and the flap constitute an integral, one-piece member which, itself, may constitute part of a continuous web of identical members. The return receipt card constitutes an integral, one-piece part of the rear panel and requires no additional attachment or gluing steps accessed to the inside surface of the return receipt card is available without manipulation, prior to location of the contents within the envelope.

Figure 10:
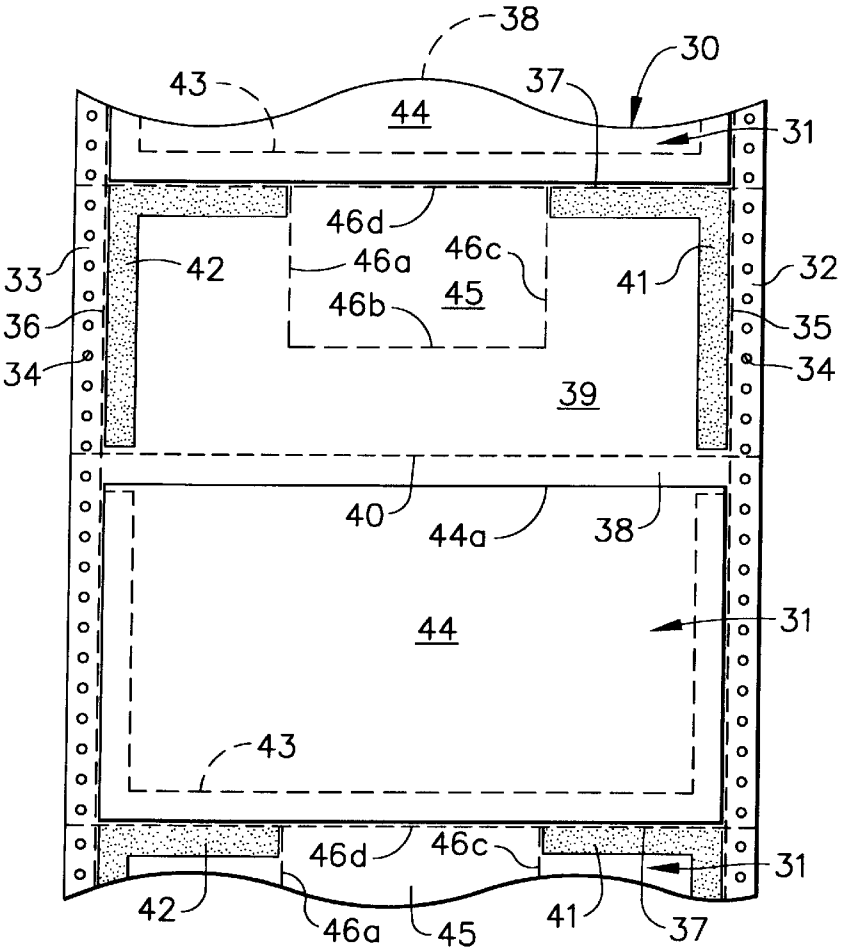
FIG. 10 is a fragmentary elevational view of a second embodiment of the present invention illustrating a continuous strip of front panel and flap members showing the inside surfaces thereof.

The basic principle of the present invention is carried through in the second embodiment of a certified mail envelope illustrated in FIGS. 10 through 14. Reference is first made to FIG. 10 which illustrates a continuous strip, generally indicated at 30, made up of a plurality of envelope front panel and flap members or segments, generally indicated at 31. The longitudinal edges of strip 30 are provided with conventional, narrow drive strips 32 and 33, provided with holes 34 spaced therealong. The strips 32 and 33 enable the advancement of the main strip 30 through a conventional printer having a pin feed or sprocket-type advancing mechanism. Strips 32 and 33 are severable from the main strip 30 along longitudinal lines of perforations 35 and 36. Again, the strips 32 and 33 are optional and it is within the scope of the invention to eliminate them, if not needed.

The equal length segments 31 are separated from each other by transverse lines of perforations 37, two of which are shown. Each segment 31, between adjacent lines of perforation 37, constitutes a front panel 38 and a flap 39. The front panel 38 and the flap 39 of each segment 31 constitute an integral, one-piece part with a fold line 40 delineating the front panel 38 and the flap 39.

Flap 39 is provided on its inner surface with two L-shaped bands of remoistenable glue 41 and 42 by which the flap may be held in its closed position, as will be shown hereinafter. In a similar fashion, the front panel of the envelope may be provided with a U-shaped band of glue 43 having a base portion extending just inside the adjacent one of the transverse lines of perforation 37 and leg portions extending just inside the longitudinal lines of perforation 35 and 36. The U-shaped band of glue 43 serves as the means by which the rear panel 44 is affixed to the front panel 38. The free ends of the U-shaped band of glue 43 terminate just short of fold line 40 and the upper edge 44*a* of rear panel 44. It will be understood by one skilled in the art that the U-shaped band of glue 43 could be located on the inside surface of rear panel 44 instead of the inside surface of front panel 38.

Each segment 31 of the strip 30 is completed by providing each flap 39 with a return receipt card 45. The return receipt card 45 is an integral, one-piece part of flap 39 and is defined by lines of perforations 46*a*, 46*b*, and 46*c*. It will be noted that the fourth edge 46*d* of the return receipt card is located at the transverse line of perforations 37, which defines the free edge of flap 39.

Figure 11:
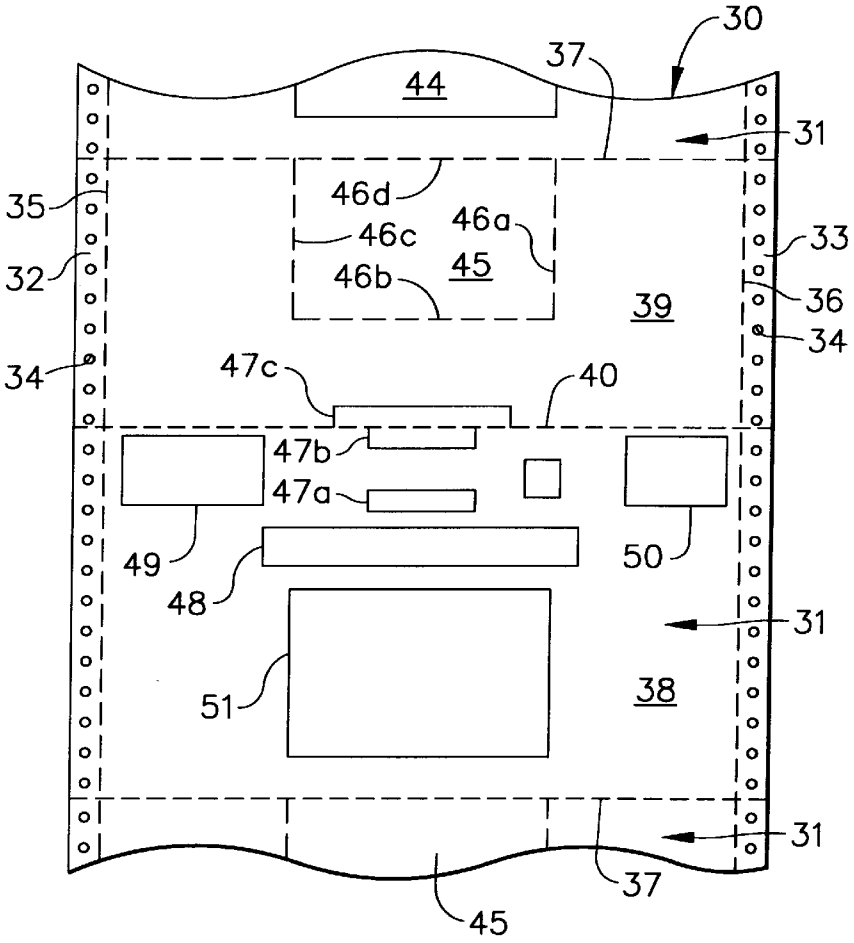
FIG. 11 is a fragmentary elevational view of the continuous strip of FIG. 10 illustrating the exterior surfaces thereof.

Reference is now made to FIG. 11 which is a fragmentary view of the strip 30, illustrating its exterior surface. Again, like parts have been given like index numerals. On the exterior surface of flap 39, the return receipt card 45 may be preprinted with all of the necessary indicia to be completed by the addressee in accordance with the instructions of the United States Postal Service. Similarly, the inside surface of return receipt card 45 may be preprinted with the sender's address when the sender is one who generates a large quantity of certified mail.

The exterior side of the front panel may be preprinted with a Certified Mail endorsement shown at 47*a*, 47*b*, and 47*c*. The Certified Mail endorsement is preferably centered with respect to transverse fold line 40. It will be noted that the part 47*c* of the endorsement extends onto flap 39.

The words "RETURN RECEIPT REQUESTED" (not shown) may be printed in the area designated by the imaginary rectangle 48. Imaginary rectangle 49 indicates an area to receive a return address. Imaginary rectangle 50 indicates an area for postage or a postage permit. In instances where the sender generates a large quantity of Certified Mail, the sender's return address may be preprinted on front panel 38. Front panel 38, if desired, may be provided with a window 51. The contents of the envelope will display the addressee's address through window 51. Alternatively, window 51 may be eliminated and the addressee's address may be printed or typed on the envelope in the same general area.

The space 47*d* between portions 47*a* and 47*b* of the Certified Mail endorsement is adapted to receive the article number, as is well known in the art. Again, it would be within the scope of the invention to provide a window in space 47*d* through which the article number, imprinted on the envelope contents, could be viewed. As described with respect to the first embodiment, a small block of taggant ink may be located as at 47*e*.

Figure 12:
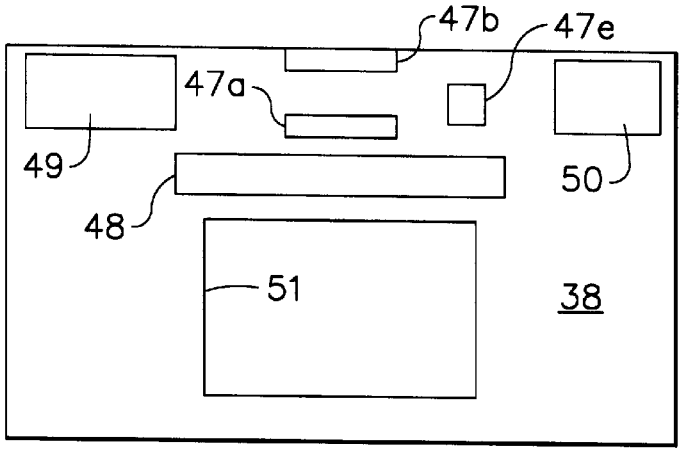
FIG. 12 is a front elevational view of the envelope of the second embodiment of the present invention.
Figure 13:
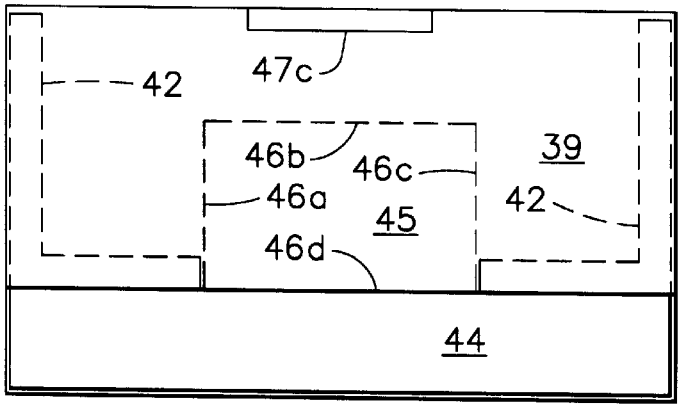
FIG. 13 is a rear elevational view of the envelope of FIG. 12.

FIGS. 12 and 13 illustrate respectively the front and rear of an envelope having been removed from the strip 30; stripped of its narrow drive strips (if present); and with its flap in closed and sealed position. It will be understood that when the window 51 is present, it could be provided with a clear cover adhered to the inside surface of front panel 38, as shown in FIGS. 8 and 9. With respect to FIG. 13, it will be noted that the free edge 46*d* of the return receipt card 45 is not adhesively affixed to rear panel 44. Thus, the addressee can insert a finger beneath edge 46*d* and remove the return receipt card 45 along the lines of perforations 46*a*, 46*b* and 46*c*.

Figure 14:
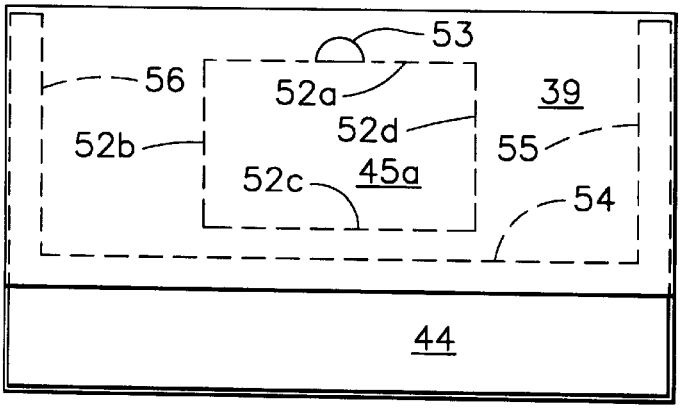
FIG. 14 is a rear elevational view, similar to FIG. 13, but illustrating an alternative location of the return receipt card.

Reference is now made to FIG. 14. This Figure is a rear elevational view of the envelope similar to FIG. 13. In this instance, however, the return receipt card 45*a* is more nearly centered with respect to envelope flap 39. Again, the return receipt card 45*a* is an integral, one-piece part of flap 39 and is defined by lines of perforations 52*a*, 52*b*, 52*c* and 53*d*. Any one of the lines just described could be provided with a semi-circular opening in the flap, similar to the opening 19 of the first embodiment, and serving the same purpose. In FIG. 14, the opening is located along line of perforations 52*a* and is indicated at 53.

The placement of the return receipt card 45*a* is such that the free end of flap 39 may have a band of remoistenable glue on its inside surface and extending the full width of the flap. Such a band is shown at 54 in FIG. 14. The moistenable glue bands 55 and 56 may be provided, extending along the ends of flap 39.

It will be understood that the glue strips 42 of FIG. 13 and 54, 55 and 56 of FIG. 14 could be pressure sensitive glue. A protective release paper or release papers could be provided both in the embodiment of FIG. 13 and the embodiment of FIG. 14 in any of the ways described with respect to the embodiment of FIGS. 1 through 9.

The embodiment of the envelope of the present invention illustrated in FIGS. 10 through 14 may be made of the same general dimensions as described with respect to the exemplary embodiment of FIGS. 1 through 9, including the indicia thereon and the like. Either embodiment could be made in any size required to receive the material to be sent to the addressee. In the second embodiment the front panel and the flap which would be made of a 100 pound white tag or other paper card stock having a thickness of 0.007 inch. In the embodiment of FIGS. 10 through 14, the rear panel would be made of 15, 20 or 24 pound bond paper. The use of the envelope of FIGS. 10 through 14 would be substantially the same as the embodiments of FIGS. 1 through 9 and the embodiment of FIGS. 10 through 14 will possess the same advantages.

Modifications may be made in the invention without departing from the spirit of it.

What is claimed:

1. An envelope assembly for certified mail comprising a first segment having outside and inside surfaces, continuous longitudinal edges and being made of thin card stock, said first segment being made up of a panel and a closure flap, said panel and closure flap constituting an integral one-piece structure with a transverse fold line between said panel and said closure flap, a return receipt card comprising an integral one-piece part of one of said flap and said panel, said return receipt card having peripheral edges defined by lines of perforations, said return receipt card being removable from its respective first segment along said peripheral lines of perforations, said return receipt card being preprinted both on said outside and said inside surfaces with conventional color and indicia, a second paper segment comprising a discrete panel having inside and outside surfaces, a top edge, a bottom edge and side edges, said second segment having its inside surface adhesively attached to said inside surface of said panel of said first segment along said side and bottom edges of said second segment, said upper edge of said second segment lying near and parallel to said fold line of said first segment and defining an envelope opening between said first card stock panel and said second paper panel, at least one band of adhesive on said inside surface of said flap extending transversely thereof to adhere said flap to said paper panel when folded thereagainst to close said envelope opening.

2. The structure claimed in claim 1 wherein said first segment comprises a rear panel and a closure flap constituting an integral one-piece part of said rear panel with a transverse fold line therebetween, said rear panel and closure flap having side edges, said flap having a free top edge parallel to said fold line, said rear panel having a lower edge parallel to said fold line, said rear panel and closure flap having outside and inside surfaces, said return receipt card comprising an integral one-piece part of said rear panel, said closure flap having preprinted on its outside surface a Certified Mail endorsement located centrally thereof and adjacent said fold line of said closure flap and a return receipt request beneath said Certified Mail endorsement, said second ply comprising a front panel, said front panel being adhesively attached to said inside surface of said rear panel along said front and rear panel sides and bottom edges, said top edge of said front panel lying near and parallel to said fold line of said rear panel and flap and defining an envelope opening between said front and rear panels, at least one band of adhesive on the inside surface of said flap and extending transversely thereof to adhere said flap to said front panel when folded thereagainst to close said envelope opening.

3. The structure claimed in claim 2 wherein each has said closure flap, said rear panel and said envelope assembly has a transverse width of 10.5 inches.

4. The structure claimed in claim 2 wherein said envelope opening is greater than 8.5 inches in length.

5. The structure claimed in claim 2 wherein said front panel has a window formed therein.

6. The structure claimed in claim 5 including a panel of transparent material in said window.

7. The structure claimed in claim 5 wherein said window is so located in said front panel as to overlie said inner surface of said return receipt card.

8. The structure claimed in claim 2 including a finger opening in said rear panel adjacent one of said peripheral lines of perforations defining said return receipt card of said rear panel to assist in removal of said return receipt card from said rear panel.

9. The structure claimed in claim 2 including the sender's return address preprinted on said outer surface of said flap.

10. The structure claimed in claim 2 including a bar code preprinted on the outer surface of said front panel.

11. The structure claimed in claim 2 wherein said rear panel and closure flap is made of card stock having a thickness of 0.007 inch.

12. The structure claimed in claim 2 wherein said front panel is made of paper chosen from the class consisting of 15 pound bond paper, 20 pound bond paper and 24 pound bond paper.

13. The structure claimed in claim 2 wherein said at least one band of adhesive on said closure flap comprises a remoistenable adhesive.

14. The structure claimed in claim 2 wherein said at least one band of adhesive on said closure flap comprises a pressure sensitive adhesive with a removable protective release tape.

15. The structure claimed in claim 2 including an article number viewing window formed in said flap at said Certified mail endorsement.

16. The structure claimed in claim 1 wherein said first segment comprises a front panel and a closure flap constituting an integral one-piece part of said front panel with a transverse fold line therebetween, said front panel and closure flap having side edges, said flap having a free top edge parallel to said fold line, said front panel having a lower edge parallel to said fold line, said front panel and closure flap having outside and inside surfaces, said return receipt card comprising an integral one-piece part of said flap, said front panel having preprinted on its outside surface a Certified Mail endorsement located centrally thereof and adjacent said fold line of said closure flap and a return receipt request beneath said Certified mail endorsement, said second segment comprising a rear panel said rear panel being adhesively attached to said inside surface of said rear panel along said front and rear panel sides and bottom edges.

17. The structure claimed in claim 16 wherein said closure flap, said front panel and said rear panel of said envelope assembly each has a transverse width of 10.5 inches.

18. The structure in claim 16 wherein the opening of said envelope assembly is greater than 8.5 inches in length.

19. The structure claimed in claim 16 wherein said front panel of said envelope assembly has a window formed therein.

20. The structure claimed in claim 19 including a panel of transparent material in said window.

21. The structure claimed in claim 16 including a finger opening in said flap panel adjacent one of said peripheral lines of perforations defining said return receipt card of said flap to assist in removal of said return receipt card from said flap.

22. The structure claimed in claim 16 including the sender's return address preprinted on said outer surface of said front panel.

23. The structure claimed in claim 16 including a bar code preprinted on the outer surface of said front panel.

24. The structure claimed in claim 16 wherein said front panel and closure flap is made of card stock having a thickness of 0.007 inch.

25. The structure claimed in claim 16 wherein said rear panel is made of paper chosen from the class consisting of 15 pound bond paper, 20 pound bond paper and 24 pound bond paper.

26. The structure claimed in claim 16 wherein said at least one band of adhesive on said closure flap comprises a remoistenable adhesive.

27. The structure claimed in claim 16 wherein said at least one band of adhesive on said closure flap comprises a pressure sensitive adhesive with a removable protective release tape.

28. The structure claimed in claim 16 including an article number viewing window formed in said front panel at said Certified Mail endorsement.

29. The structure claimed in claim 1 including a plurality of said first segments formed as a continuous strip to create a continuous strip of Certified Mail envelope assemblies for feeding through a computer printer, said continuous strip having outside and inside surfaces and continuous longitudinal edges, said continuous strip being made of thin card stock, said continuous strip being divided longitudinally into said first segments by transverse lines of perforations, each segment comprising a panel and a closure flap of an envelope assembly, said panel and closure flap of each first segment being separated by a transverse fold line, a return receipt card comprising an integral one-piece part of one of said panel and flap of each of said first segments, a plurality of said second paper segments equal in number to the number of said first segments, each second segment being adhesively attached to the inside surface of its respective first segment panel, said upper edge of each second segment panel lying near and parallel to said fold line of its respective first segment panel and closure flap assembly and defining an envelope opening between said paper and card stock panels, at least one band of adhesive on the inside surface of each flap extending transversely thereof to adhere each flap to its respective paper panel when folded thereagainst to close its respective envelope opening, each first segment and second segment comprising an envelope assembly.

30. The structure claimed in claim 29 wherein each card stock panel of each segment of said strip comprises the rear panel of its respective envelope and each paper panel comprises the front panel of its respective envelope, said return receipt card of each strip segment being formed in said rear panel thereof, said closure flap of each strip segment having preprinted on its outside surface a Certified Mail endorsement located centrally thereof and adjacent said fold line of said closure flap and a return receipt request beneath said Certified Mail endorsement.

31. The structure claimed in claim 30 including a narrow perforated drive strip extending along each longitudinal edge of each of said first segments, a line of perforations between each drive strip and its respective longitudinal edge of said first segment along which each narrow drive strip is severable from said first segment.

32. The structure claimed in claim 30 wherein said closure flap, said rear panel and said front panel of each envelope assembly have a transverse width of 10.5 inches.

33. The structure claimed in claim 30 wherein the opening of each envelope assembly is greater than 8.5 inches in length transversely of said strip.

34. The structure claimed in claim 30 wherein each front panel of each envelope assembly has a window formed therein.

35. The structure claimed in claim 34 including a panel of transparent material in said window.

36. The structure claimed in claim 34 wherein each window is so located in its front panel as to overlie said inner surface of its respective return receipt card.

37. The structure claimed in claim 30 including a finger opening in each of said rear panels adjacent one of said peripheral lines of perforations defining said return receipt card of said rear panel to assist in removal of said return receipt card from said rear panel.

38. The structure claimed in claim 30 including a return address preprinted on said outer surfaces of said flaps.

39. The structure claimed in claim 30 including a bar code preprinted on the outer surface of said front panels.

40. The structure claimed in claim 30 wherein said continuous strip is made of card stock having a thickness of 0.007 inch.

41. The structure claimed in claim 30 wherein said front panel is made of paper chosen from the class consisting of 15 pound bond paper, 20 pound bond paper and 24 pound bond paper.

42. The structure claimed in claim 30 wherein said at least one band of adhesive on each closure flap comprises a remoistenable adhesive.

43. The structure claimed in claim 30 wherein said at least one band of adhesive on each closure flap comprises a pressure sensitive adhesive with a removable protective release tape.

44. The structure claimed in claim 30 including an article number viewing window formed in said flap at said Certified Mail endorsement.

45. The structure claimed in claim 29 wherein each card stock panel of each segment of said strip comprises the front panel of its respective envelope assembly and each paper panel comprises the rear panel of its respective envelope assembly, said return receipt card of each strip segment being formed in said flap thereof, said front panel of each strip segment having preprinted on its outside surface a Certified Mail endorsement located centrally thereof and adjacent said fold line of said closure flap and a return receipt request beneath said Certified Mail endorsement.

46. The structure claimed in claim 45 including a narrow perforated drive strip extending along each longitudinal edge of said strip, a line of perforations between each drive strip and its respective longitudinal edge of said first segment along which each narrow drive strip is severable from said first segment.

47. The structure claimed in claim 45 wherein said closure flap, said front panel and said rear panel of each structure have a transverse width of 10.5 inches.

48. The structure claimed in claim 45 wherein the opening of each envelope assembly is greater than 8.5 inches in length transversely of said strip.

49. The structure claimed in claim 45 wherein each front panel of each envelope assembly has a window formed therein.

50. The structure claimed in claim 49 including a panel of transparent material in said window.

51. The structure claimed in claim 45 including a finger opening in each of said flaps adjacent one of said peripheral lines of perforations defining said return receipt card of said flap to assist in removal of said return receipt card from said flap.

52. The structure claimed in claim 45 wherein one of said peripheral edges of said return receipt card is also part of the top edge of its respective flap.

53. The structure claimed in claim 45 including a return address preprinted on said outer surfaces of said front panels.

54. The structure claimed in claim 45 including a bar code preprinted on the outer surface of said front panels.

55. The structure claimed in claim 45 wherein said continuous strip is made of card stock having a thickness of 0.007 inch.

56. The structure claimed in claim 45 wherein said rear panel is made of paper chosen from the class consisting of 15 pound bond paper, 20 pound bond paper and 24 pound bond paper.

57. The structure claimed in claim 45 wherein said at least one band of adhesive on each closure flap comprises a remoistenable adhesive.

58. The structure claimed in claim 45 wherein said at least one band of adhesive on each closure flap comprises a pressure sensitive adhesive with a removable protective release tape.

59. The structure claimed in claim 45 including an article number viewing window formed in said front panel at said Certified Mail endorsement.

* * * * *